US005676573A

United States Patent [19]

Wright

[11] Patent Number: 5,676,573

[45] Date of Patent: Oct. 14, 1997

[54] CONNECTOR KIT, CONNECTOR ASSEMBLY AND METHOD OF MAKING CONNECTOR ASSEMBLY

[75] Inventor: John O. Wright, York, Pa.

[73] Assignee: Osram Sylvania Inc., Danvers, Mass.

[21] Appl. No.: 607,668

[22] Filed: Feb. 27, 1996

[51] Int. Cl.[6] ..... H01R 4/50

[52] U.S. Cl. ..... 439/863; 439/888; 439/578

[58] Field of Search ..... 439/863, 888, 439/775, 733.1, 578

[56] References Cited

U.S. PATENT DOCUMENTS 4,505,534 3/1985 Shannon ..... 439/885

5,082,461 1/1992 Minnis et al. ..... 439/888

*Primary Examiner*—Gary F. Paumen

*Attorney, Agent, or Firm*—William H. McNeill

[57] ABSTRACT

A connector is provided including a plastic bushing having a first bore which extends therethrough in a first direction and a second bore which extends into the bushing in a second direction and intercepts the first bore. A contact extends into one end of the first bore to a surface area facing the second bore, and a central conductor of a coaxial cable may be extended into an opposite end of the first bore to such contact. A retaining member may be inserted into the second bore until the retaining member engages the central conductor to sandwich the central conductor between such retaining member and the contact. The plastic bushing may be inserted into a conductive connector shell which is connected to the coaxial cable and engages a shield layer of such coaxial cable.

19 Claims, 5 Drawing Sheets

CONNECTOR KIT, CONNECTOR ASSEMBLY AND METHOD OF MAKING CONNECTOR ASSEMBLY

TECHNICAL FIELD

The present invention relates to a connector kit a connector assembly and a method of securing a connector to an end of a coaxial cable. The present invention is particularly useful in connection with an antenna connector.

BACKGROUND ART

A typical antenna connector for an antenna cable such as those used in the automobile industry for radios includes a male connector body generally in the form of a plug and a female connector body generally in the form of a ferrule which forms a socket. In use, the male connector body is plugged into the female connector body to effect a mechanical and electrical connection between the two. Typically, an antenna cable in the form of a coaxial cable is electrically and mechanically attached to one of the connectors such as the male connector, and the other connector, such as the female connector, is electrically and mechanically attached to a circuit such as a circuit on a printed circuit board. In such prior art devices the lack of satisfactory tactile feedback makes it difficult to know when a suitable connection has been made. In addition, in assembling prior art connector assemblies, it is usually necessary to trim the end of the coaxial cable and then fold the shield layer back upon the cable to provide a satisfactory ground. Further, the grounding between the mating connectors has not always been satisfactory due to the somewhat loose connection between the male and female connectors. Efforts to tighten up on such connections provides mating connectors which are difficult to couple together. In addition, many prior art connector assemblies require the use of solder. Further, there is difficulty in effecting a connector assembly which includes a gas tight connection.

DISCLOSURE OF INVENTION

It is an object of the present invention to provide a connector which provides tactile feedback when coupled to a mating connector.

It is a further object of the present invention to provide a connector which does not require trimming of the coaxial cable to which the connector is to be attached and the folding of the shield layer back upon itself.

Yet a further object of the present invention is to provide a connector which allows for high pressure grounding between mated connectors.

Another object of the resent invention is to provide a connector which allows for force differentiation which facilitates the coupling and uncoupling of mating connectors.

Yet another object of the present invention is to provide a connector which does not require the use of solder.

A further object of the present invention is to provide a connector which allows for effecting a connector assembly having a gas tight connection.

These objects are achieved, in one aspect of the invention, by providing a connector kit, a connector assembly and a method of securing a connector to an end of a coaxial cable. The parts of the kit may comprise an insulative bushing, a conductive contact, a retaining member and a conductive connector shell. Although the conductive contact is referred to herein as a ferrule of the type used to provide a female connector for use with a mating male connector, the conductor contact may be a male contact to provide a male connector for use with a mating female connector, the present invention being directed to any type of conductive contact which may be embodied in the present invention as described herein. The method involves the manner in which some or all of these parts may be assembled to provide a connector assembly. Such connector assembly comprises an insulative bushing extending in a longitudinal direction relative to an axis of the insulative bushing, from a first bushing end to an opposite second bushing end. The insulative bushing comprises a first bore extending in the longitudinal direction from the first bushing end to the opposite second bushing end. A second bore extends from an outer surface of the insulative bushing to the first bore. The first bore comprises a first bore surface having a first bore surface portion facing the second bore. A conductive contact extends into the first bore from the first bushing end towards the opposite second bushing end. The conductive contact comprises a contact arm which extends in the longitudinal direction towards the opposite second bushing end. The contact arm engages the first bore surface portion. A retaining member is positioned in the second bore, the retaining member being held in place relative to the first bore surface portion. A central conductor of a coaxial cable extends into the first bore from the opposite second bushing end towards the first bushing end, a distal end segment of the central conductor being sandwiched between the conductive contact and the retaining member. The connector assembly may also include a conductive connector shell which extends in the longitudinal direction from a first connector shell end to an opposite second connector shell end. The second connector shell end is attached to the coaxial cable and engages a shield layer of the coaxial cable. The insulative bushing extends into the conductive connector shell.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
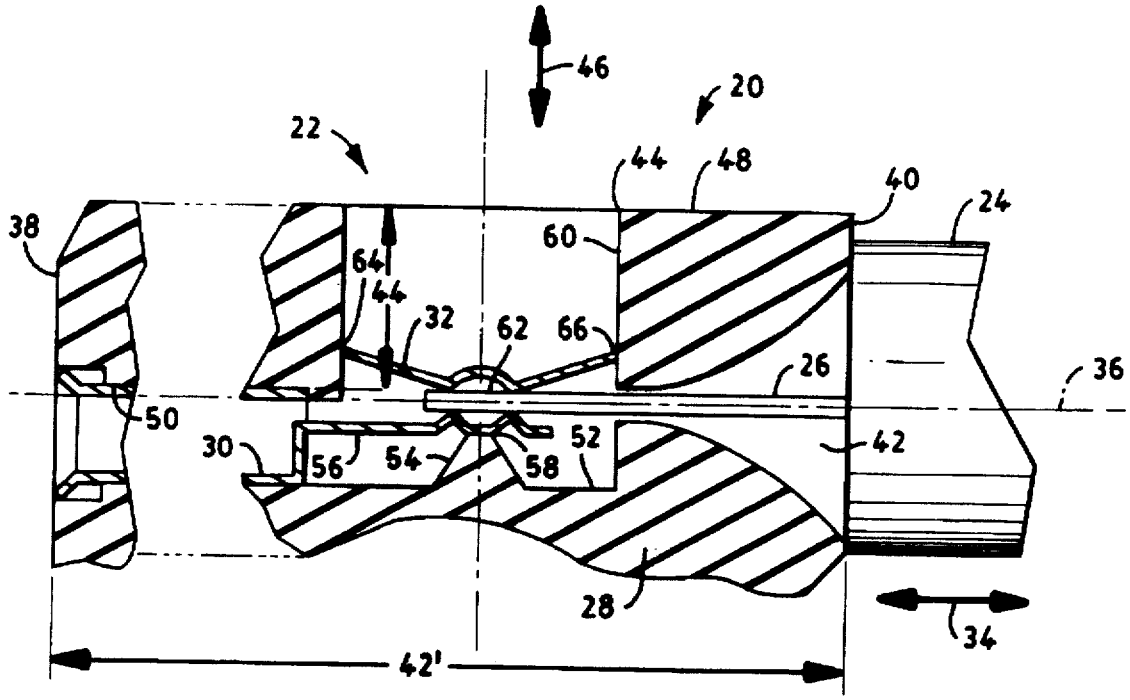
FIG. 1 is a view of a kit assembled to provide a connector assembly embodying the present invention.

The embodiment of this invention which is illustrated in the drawings is particularly suited for achieving the objects of this invention. In the embodiment of FIG. 1, a connector assembly 20 is provided. Connector assembly 20 comprises a connector 22 and a coaxial cable 24 having a length of central conductor 26 extending from an end thereof. The connector 22 may be in the form of a kit which comprises an insulated bushing such as a plastic bushing 28, a conductive contact such as a metal ferrule 30, and a conductive resilient retaining member 32. Such kit parts are depicted assembled with the coaxial cable 24 in FIG. 1. Metal ferrule 30 may be replaced with a metal male connector if desired.

The insulative bushing 28 extends in a longitudinal direction 34 relative to an axis 36 of the insulative bushing from bushing end 38 to opposite bushing end 40. A first bore 42, having a length 42', extends in longitudinal direction 34 from end 38 to end 40. A second bore 44, having a length 44', extends in a radial direction 46 relative to axis 36 from an outer surface 48 of the insulative bushing 28 to the first bore 42. The first bore 42 comprises a surface 50 having a portion 52 which faces the second bore 44. In the embodiment of FIG. 1, the portion 52 of the surface 50 comprises a raised portion 54 which extends from surface 50 towards bore 44.

In the embodiment of FIG. 1, the conductive ferrule 30 extends into the bore 42 from end 38 towards end 40. Without limitation, the conductive ferrule 30 may be held in place relative to bore surface 50 by providing a press fit between the conductive ferrule and such bore surface. The conductive ferrule 30 comprises a contact arm 56 which extends in the longitudinal direction 34 towards end 40. Contact arm 56 engages the first bore surface portion 52 at an upper surface 58 of the raised portion 54. If desired, ferrule 30 may be replaced with a male contact (not shown) having a contact arm such as contact arm 56.

Figure 2:
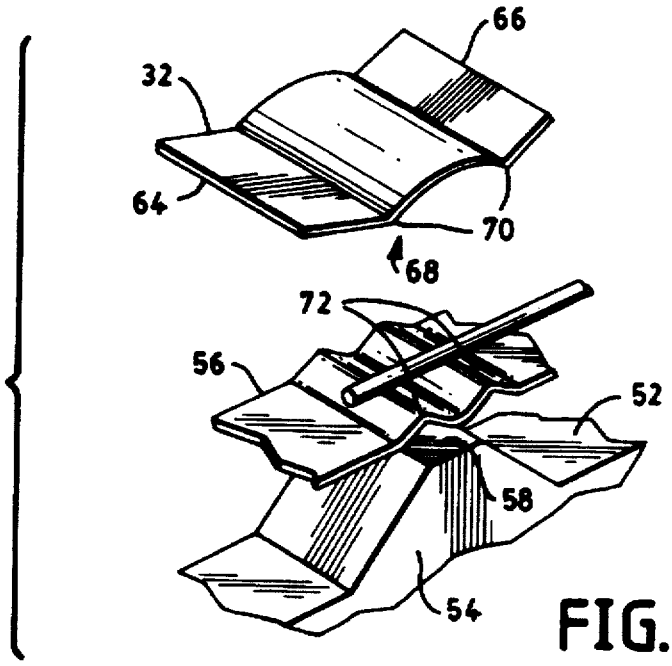
FIG. 2 is an exploded view of the electrical connection depicted in FIG. 1.

The retaining member 32 is positioned in the bore 44 and is held in place relative to the bore surface portion 52 of bore 50 by the bore surface 60 of the bore 44 as explained hereinafter. The central conductor 26 of the coaxial cable 24 extends into the bore 42 from end 40 towards end 38 of the insulative bushing 28. Insertion of the central conductor 26 into bore 42 may be facilitated by providing a funnel-like entrance to bore 42 at end 40 as depicted in FIG. 1. A distal end segment 62 of the central conductor 26 is sandwiched between contact arm 56 and the retainer member 32. In the embodiment of FIGS. 1 and 2, the retaining member 32 comprises a resilient crimp plate having opposing edges 64,66 which are urged against opposite areas of the bore surface 60. Such resilient crimp plate also comprises a lower surface 68 which engages the distal end segment 62 of the central conductor 26. For example, in the embodiment of FIGS. 1 and 2, the lower surface 68 of the resilient crimp plate 32 comprises two protuberances 70 which extend towards and engage the central conductor 26 at the distal end segment 62. In the embodiment of FIGS. 1 and 2, the contact arm 56 comprises two or more protuberances 72 each of which extends towards a respective protuberance 70, the central conductor 26 being sandwiched between the protuberances 70 and 72 at the distal end segment 62. More or less than two protuberances 70, 72 may be provided, and such protuberances may be eliminated entirely from the resilient crimp plate 32 and/or the contact arm 56, if desired, although in the preferred embodiment there are two protuberance 70 and two protuberances 72 as depicted in FIGS. 1 and 2.

In the embodiment of FIG. 1, a solderless connection is effected. In effecting such connection, the crimp plate 32 is pushed through opening 44 and against the central connector 26. The edges 64, 66 of the crimp plate 32 lock into the opposing sides of bore surface 60, the resilience in the crimp plate urging the central conductor against arm 56 to provide a high normal contact force which facilitates a gas tight connection.

Figure 3:
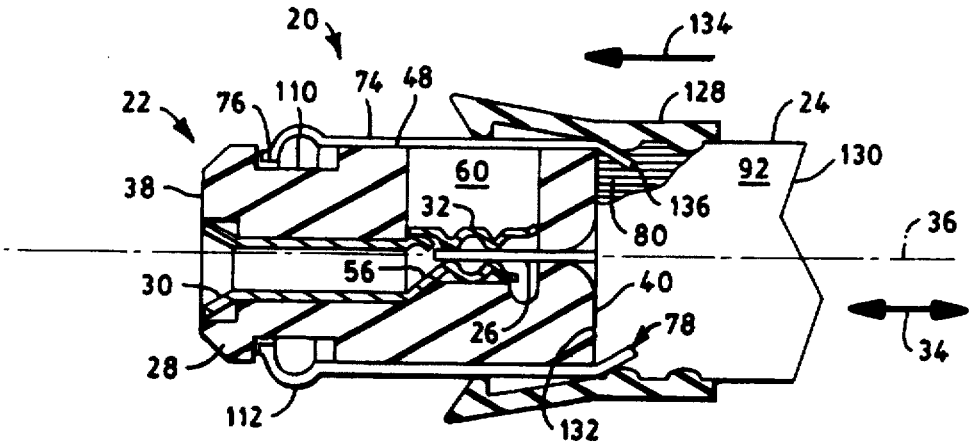
FIG. 3 is a view of a kit assembled to provide an alternative connector assembly embodying the present invention.

FIG. 3 depicts the connector assembly 20 including the connector 22, which may be in the form of a kit further comprising a resilient conductive connector shell 74. The conductive connector shell 74 extends in the longitudinal direction 34 from an end 76 to an opposite end 78. The insulative bushing 28 extends into the conductive connector shell 74. The end 78 of the conductive connector shell 74 is attached to the coaxial cable 24 and engages the shield layer 80 of the coaxial cable as described hereinafter.

Examples of the conductive connector shell 74, and alternative connector shells 74' and 74", and their attachment to the coaxial cable and engagement with the shield layer are depicted in FIGS. 3 to 9. As will be apparent hereinafter, in each instance the connector may be assembled without the need to trim the coaxial cable 24 and fold back the shield layer 80.

Figure 4:
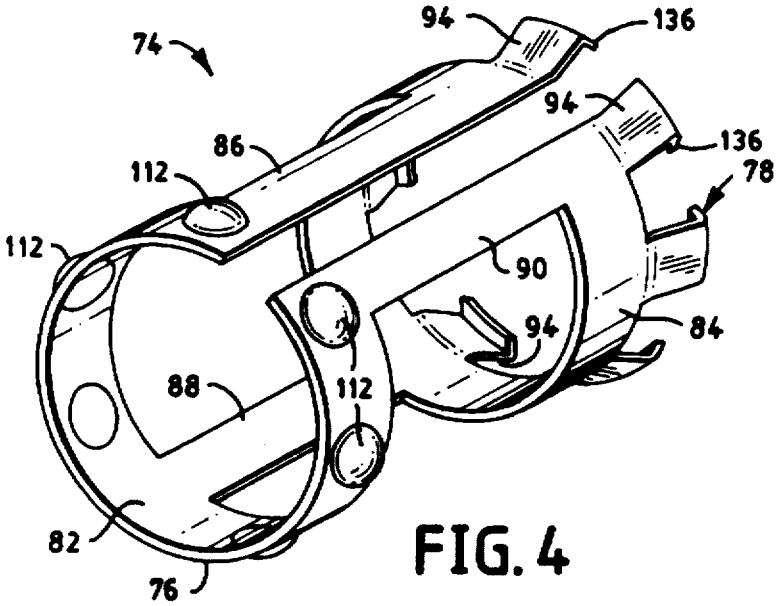
FIG. 4 is a perspective view of a conductive connector shell embodying the present invention.
Figure 5:
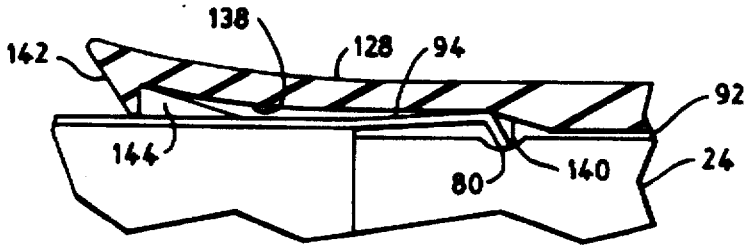
FIG. 5 is a partial view of a locking sleeve depicted in FIG. 3 in a locked position.

FIGS. 4 and 5 depict details of the conductive connector shell 74 of FIG. 3. In particular, a resilient conductive connector shell 74 is provided which is generally cylindrical in configuration. The conductive connector shell comprises a ring, which may be a split ring 82, at end 76 and a ring, which may be a split ring 84, at end 78. Split rings 82 and 84 are joined together by at least two legs which extend from one ring to the other. For example, in the embodiment of FIGS. 3 to 5, split ring 82 is joined to split ring 84 by legs 86, 88 and 90. The split ring 84 comprises a portion which is attachable to an end of the coaxial cable 24 for engagement with the shield layer 80. For example, such portion may comprise one or more tabs which extend from the split ring 84 in the longitudinal direction 34, at least one of which is insertable into an outer surface 92 of coaxial cable 24 for engagement with the shield layer 80 and attachment to the coaxial cable. In the embodiment of FIGS. 3 to 5, a plurality of such tabs 94 are provided.

Figure 6:
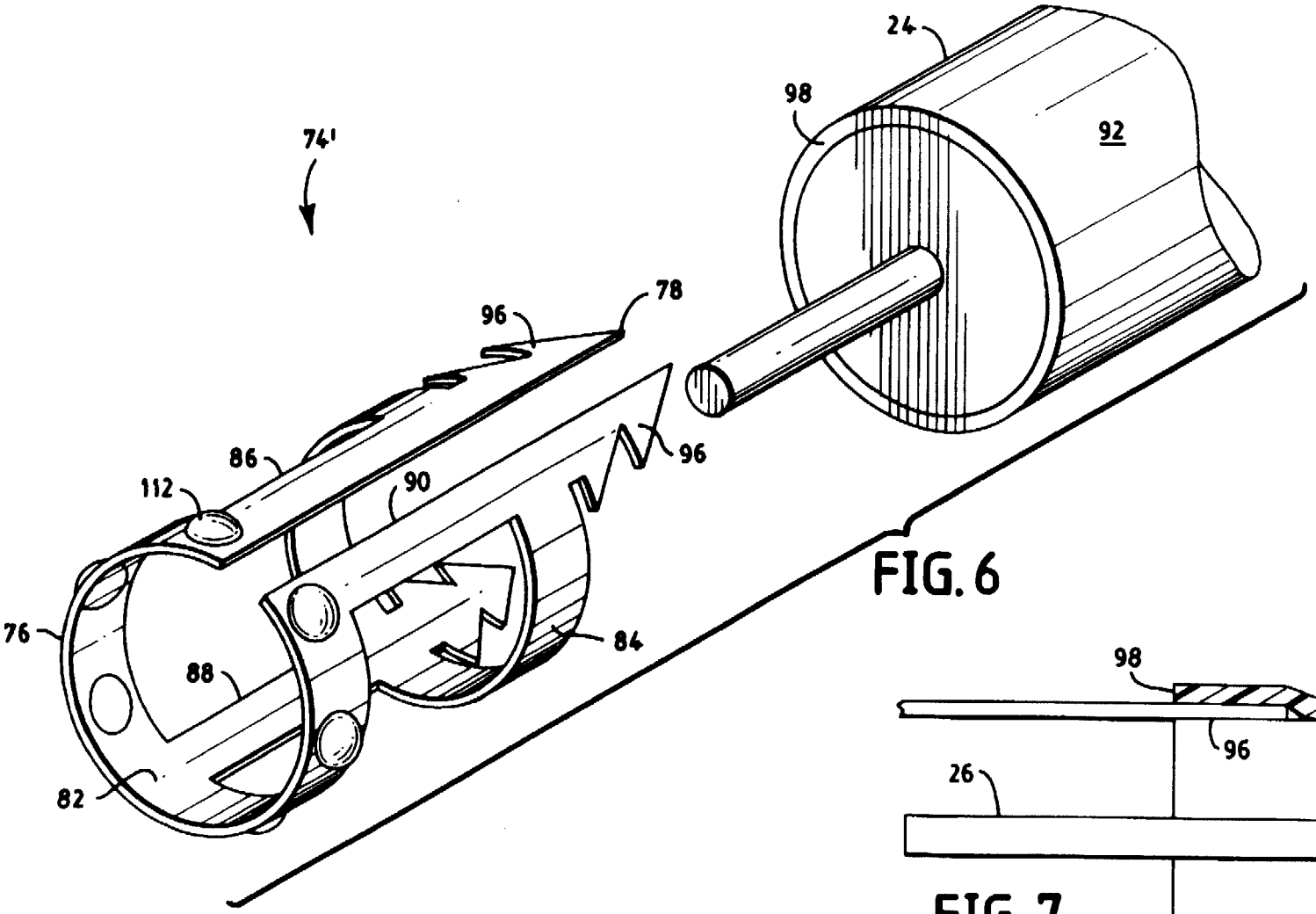
FIG. 6 is an exploded perspective view of an alternative conductive connector shell, in use, embodying the present invention.
Figure 7:
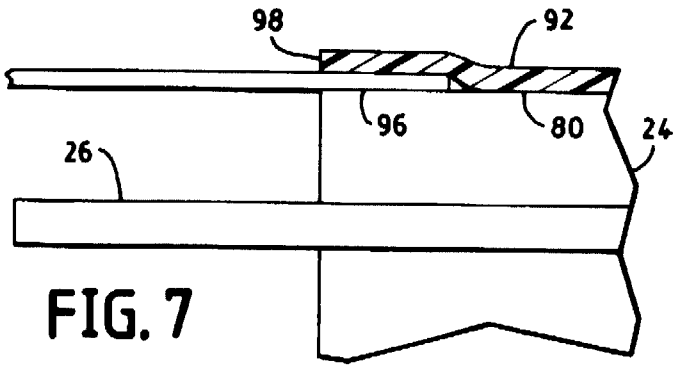
FIG. 7 is a partial view of FIG. 6 depicting the conductive connector shell attached to the coaxial cable and engaging the shield layer of such coaxial cable.

The alternative conductive connector shell 74' of FIGS. 6 and 7 is identical to the embodiment of FIG. 4 with the exception that the tabs 94 are replaced by tabs 96. In the embodiment of FIGS. 6 and 7, the tabs 96 are inserted into the end 98 of the coaxial cable 24 for engagement with the shield layer 80 and attachment to the coaxial cable. As depicted in FIG. 7, each tab 96 (only one is shown) is forced into the end 98 of the coaxial cable 24, the tabs entering the cable below the outer PVC surface layer 92 for engagement with the shield layer 80. In the preferred embodiment, the tabs 96 are pointed to facilitate pushing the tab into the end of the coaxial cable 24 and are barbed to facilitate attachment of the conductive connector shell 74' to the coaxial cable.

Figure 8:
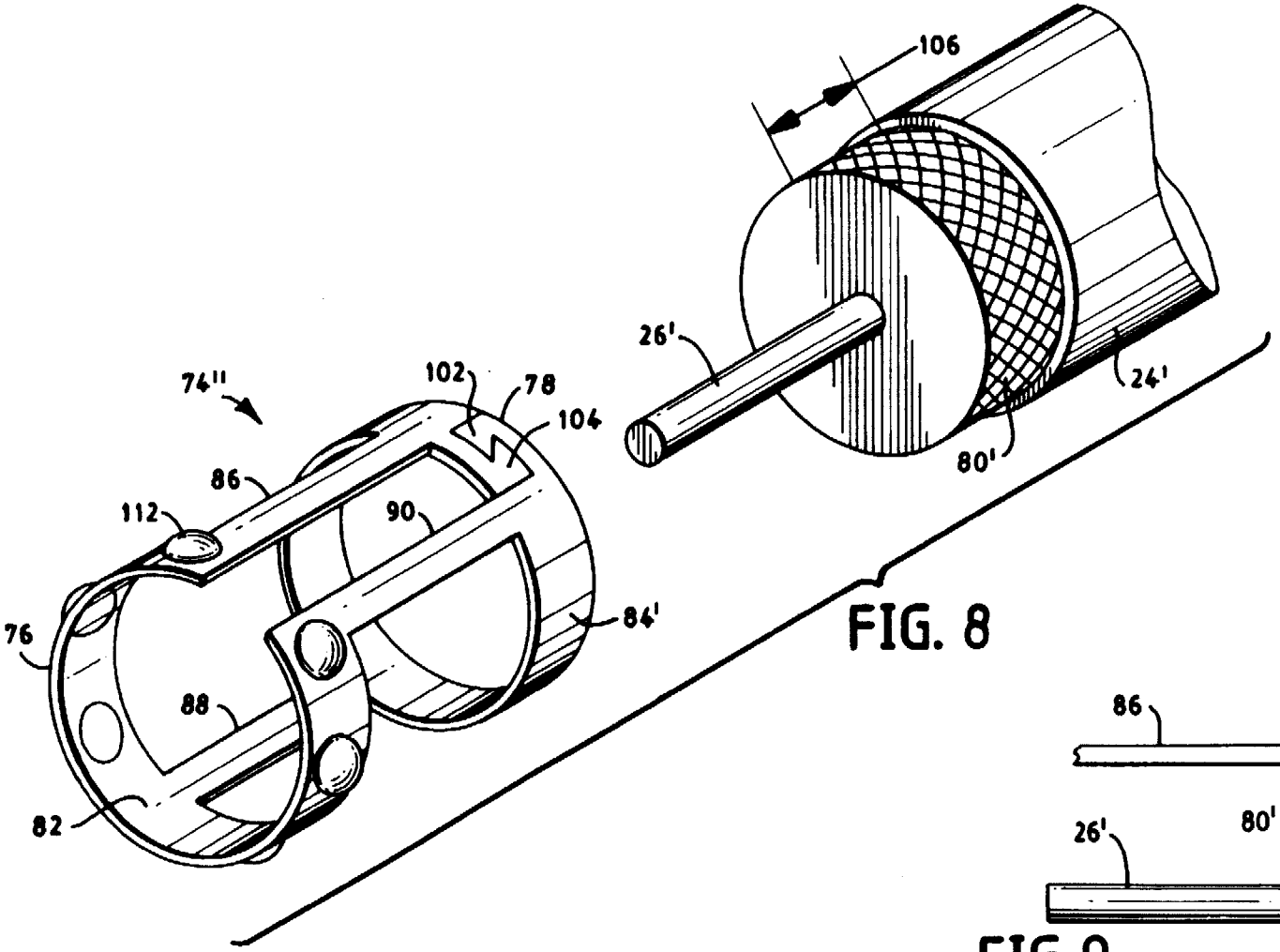
FIG. 8 is an exploded perspective view of an alternative conductive connector shell, in use, embodying the present invention.
Figure 9:
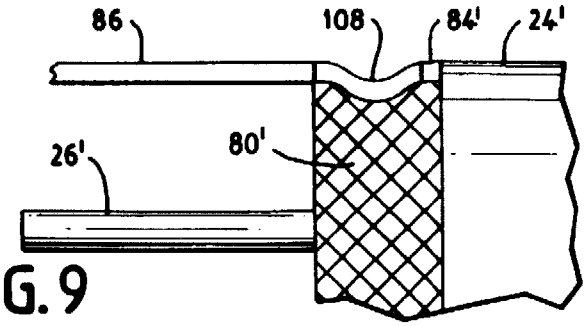
FIG. 9 is a partial view of FIG. 8 depicting the conductive connector shell attached to the coaxial cable and engaging the shield layer of such coaxial cable.

The alternative conductive connector shell 74" of FIGS. 8 and 9 is identical to conductive connector shell 74 except as described herein. The embodiment of FIGS. 8 and 9 differs from the embodiment of FIG. 4 in several respects. For example, although a split ring 82 is provided at end 76, the opposite end 78 is formed by a closed ring 84', attached together at mating ends 102, 104. In addition, the closed ring 84' does not have any tabs extending therefrom. In this embodiment, a coaxial cable 24' comprises a cable end segment comprising a length 106 of exposed shield layer 80'. The length 106 is insertable into the closed ring 84'. The conductive connector shell 74" may be electrically and mechanically coupled to the length 106 of exposed shield layer 80' by, for example, crimping the closed ring 84' at one or more locations 108 around the circumference of the closed ring.

In the embodiment depicted in FIGS. 1 to 5 the insulative bushing 28 is cylindrical in configuration. Insulative bushing 28 comprises a circumferential groove 110 which extends into outer surface 48 in the vicinity of end 38. The end 76 of the conductive connector shell 74 is adjacent circumferential groove 110. The split ring 82 has an effective outer diameter which is greater than an effective inner diameter of an inner surface of a mating connector into which the connector 22 is inserted to connect the mating connector to connector 22.

Figure 10:
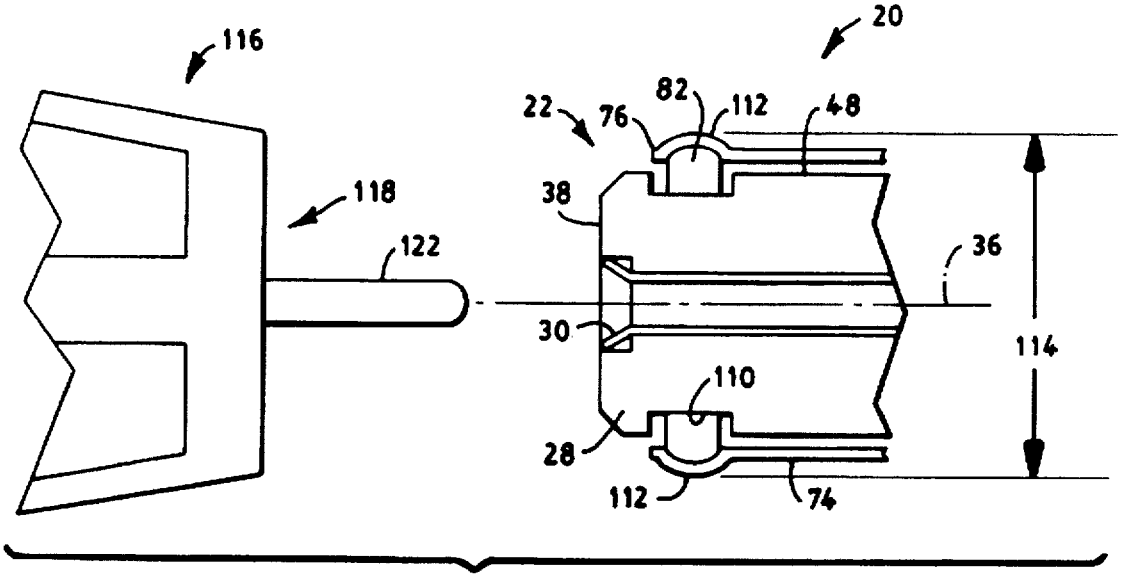
FIG. 10 is a view of mating connectors, including a connector assembly embodying the present invention, before such mating connectors are connected together.
Figure 11:
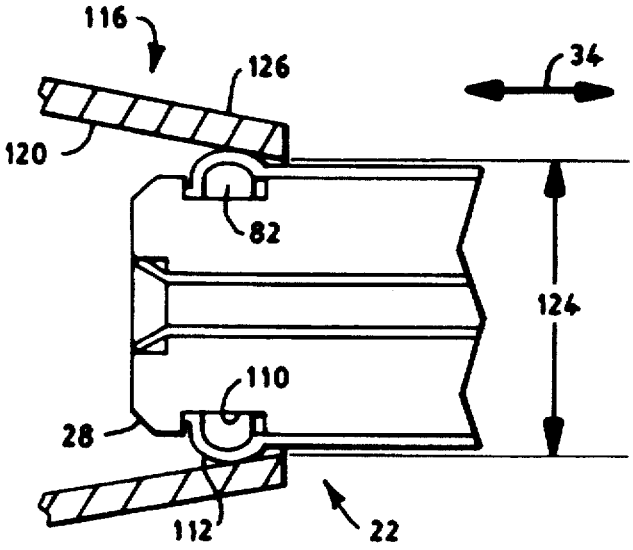
FIG. 11 is a view of the mating connectors of FIG. 10 after such mating connectors have been connected together.

For example, in the embodiment of FIGS. 3 to 5, the split ring 82 comprises a plurality of protuberances 112 which extend away from axis 36. Protuberances 112 may be any configuration such as, for example, the spherical protuberance 112. The protuberance 112 may be asymmetrical if desired, to provide force differentiation when inserting and removing the conductive connector shell 74 relative to a mating conductive connector shell. The effective outer diameter of ring 82 is defined by the distance 114 between the apex of opposing protuberances 112 as depicted in FIG. 10. FIGS. 10 and 11 depict a mating connector 116 which is a conventional connector adapted to be electrically and mechanically connected to connector 22 in the usual manner by inserting the connector 22 into the opening 118 defined by inner surface 120 of connector 116. In FIGS. 10 and 11, the connector 22 is a female connector and connector 116 is a male connector having a conventional prong 122 for inserting into ferrule 30. It will be apparent to those having ordinary skill in the art, however, that the present invention is equally applicable to other types of connectors such as those in which connector 22 is a male connector and connector 116 is a female connector. In any event, in the embodiment of FIGS. 10 and 11, the effective outer diameter 114 of connector 22 is greater than the effective inner diameter 124 of the inner surface 120 at end 126 of connector 116. Although the inner diameter 124 is formed by inner surface 120 and the effective outer diameter 114 is formed by protuberances 112, it will be apparent to those having ordinary skill in the art that the present invention is equally applicable when, for example, the ring 82 has no protuberances 112, in which case the effective outer diameter of ring 82 will be the actual outer diameter of the ring, and when the connector 116 has a bead at end 126 extending toward axis 36, in which case the inner diameter 124 will be measured relative to such bead. Similarly, the inner surface 120 may comprise the protuberances 112 and the ring 82 may be provided without protuberances. Regardless of the actual configuration, upon connecting connector 22 to connector 116 there will be a camming action therebetween to urge the ring 82 into the circumferential groove 110 which will further lock the conductive connector shell in place by preventing movement of the shell in direction 34 relative to the insulative bushing 28. In particular, the split ring 82 will be positioned radially outward of groove 110 in the disconnected mode as depicted in FIG. 10 and will be urged into groove 110 by engagement of the protuberances 112 with the inner surface 120 at end 126 in the connected mode as depicted in FIG. 11. The engagement of the protuberance 112 by the inner surface 120 at end 126 will provide tactile feedback to the user as the male and female connectors mate into place. In addition, the protuberances 112 will provide high pressure grounding to the connector 116.

As noted herein, in the embodiment of FIGS. 3 to 5, the conductive connector shell 74 includes tabs 94 at least one of which is insertable into outer surface 92 of the coaxial cable 24 for engagement with the shield layer 80 and attachment to the coaxial cable. In this embodiment, the tabs 94 actually pierce the outer PVC surface 92 of the coaxial cable 24. A sleeve such as a plastic sleeve is provided to facilitate such engagement and attachment. Sleeve 128 extends in the longitudinal direction 34 and is moveable in such direction relative to the conductive connector shell 74. In use, an end 130 of the coaxial cable 24 may be inserted into sleeve 24. Alternatively, end 132 of the coaxial cable may be inserted into sleeve 128, but such insertion must precede attachment of the insulative bushing 28 and conductive connector shell 74 to the coaxial cable. Regardless of how the coaxial cable is inserted into the sleeve 128, when the connector assembly 20, including conductive connector shell 74, are in place relative to the coaxial cable, the sleeve 128 is moved in the direction 134 so that the insulative connector shell 74 extends into the sleeve and the inner surface of the sleeve 128 cams the tabs 94 towards axis 36, the force of such camming action causing the distal ends 136 of the tabs 94 to penetrate the outer PVC layer 92 of the coaxial cable and engage the underlying shield layer 80. To this end, the inner surface of the sleeve 128 will have an inner surface portion which engages the tabs 94 to cam tabs 94 towards axis 36. For example, in the embodiment of FIGS. 3 and 5, the inner surface 138 of the sleeve 128 includes a raised inner surface portion 140 which bears against tabs 94. If desired, the sleeve 128 may be locked in place by providing a resilient sleeve having a bead 142 which cams, and snaps into place, relative to a detent 144 extending from outer surface 48 of insulative bushing 28. By providing a detent 144 having a ramp-like camming surface, when the resilience sleeve is locked in place, the sleeve will continuously exert a pressure against the tabs 94 thereby assuring a satisfactory engagement of the shield layer 80 by the tabs 94.

Fabrication of the various components described herein may be accomplished using conventional procedures. For example, the insulative bushing and sleeve may be molded from a plastic material. The conductive members including ferrule, retaining member and connector shell may be stamped from a metal sheet and then rolled and/or bent if required to form the desired configuration.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A connector assembly for a coaxial cable, comprising:

an insulative bushing extending in a longitudinal direction relative to an axis of said insulative bushing, from a first bushing end to an opposite second busing end, said insulative bushing comprising a first bore extending in said longitudinal direction from said first bushing end to said opposite second bushing end, and a second bore extending from an outer surface of said insulative bushing to said first bore, said first bore comprising a first bore surface having a first bore surface portion facing said second bore;

a conductive contact extending into said first bore from said first bushing end towards said opposite second bushing end, said conductive contact comprising a contact arm which extends in said longitudinal direction towards said opposite second bushing end, said contact arm engaging said first bore surface portion;

a discrete retaining member inserted into said second bore, said retaining member being held in place relative to said first bore surface portion; and a central conductor of a coaxial cable extending into said first bore from said opposite second bushing end towards said first bushing end, a distal end segment of said central conductor being sandwiched between said contact arm and said retaining member.

2. The connector assembly of claim 1 wherein said first bore surface portion comprises a raised portion extending from said first bore surface towards said second bore.

3. The connector assembly of claim 2 wherein said retaining member comprises a resilient crimp plate having opposing edges urged against opposite areas of a second bore surface of said second bore, and a lower surface engaging said central conductor.

4. The connector assembly of claim 3 wherein said lower surface comprises two or more first protuberances which extend towards and engage said central conductor.

5. The connector assembly of claim 4 wherein said contact arm comprises two or more second protuberances each of which extends towards a respective first protuberance of said two or more protuberances, said central conductor being sandwiched between said two or more first protuberances and said two or more second protuberances.

6. The connector assembly of claim 1 further including a conductive connector shell which extends in said longitudinal direction from a first connector shell end to an opposite second connector shell end, said second connector shell end being attached to said coaxial cable and engaging a shield layer of said coaxial cable, said insulative bushing extending into said conductive connector shell.

7. The connector assembly of claim 6 wherein said insulative bushing and said conductive connector shell are each substantially cylindrical in configuration, said insulative bushing comprises a circumferential groove which extends into said outer surface in the vicinity of said first bushing end, and said first connector shell end comprises a first ring which is adjacent said circumferential groove.

8. The connector assembly of claim 7 wherein said first ring comprises one or more protuberance which extends away from said longitudinal axis.

9. The connector assembly of claim 8 wherein said first ring has an effective outer diameter which is greater than an effective inner diameter of an inner surface of a mating connector into which said connector is adapted to be inserted to connect said connector to said mating connector, said ring being positioned radially outward of said groove in a disconnected mode, and being urged into said groove by engagement of said plurality of protuberances with said inner surface in a connected mode.

10. The connector assembly of claim 1 further including a conductive connector shell which extends in said longitudinal direction from a first connector shell end to an opposite second connector shell end, said first connector shell end comprising a first ring and said second connector shell end comprising a second ring, said first ring being joined to said second ring by two or more legs which extend in said longitudinal direction, said second connector shell end being attached to said coaxial cable and engaging a shield layer of said coaxial cable, and said insulative bushing extending into said conductive shell.

11. The connector assembly of claim 10 wherein said insulative bushing and said conductive connector shell are each substantially cylindrical, and said insulative bushing comprises a circumferential groove which extends into said outer surface in the vicinity of said first bushing end, said first ring being adjacent said circumferential groove.

12. The connector assembly of claim 11 wherein said first split ring comprises a plurality of protuberances which extend away from said axis.

13. The connector assembly of claim 6 wherein said second connector shell end comprises at least one tab which extends in said longitudinal direction, said at least one tab extending into an end of said coaxial cable and engaging said shield layer.

14. The connector assembly of claim 6 wherein said second connector shell end comprises one or more tabs extending in said longitudinal direction, at least one tab of said one or more tabs having a distal end which penetrates an outer layer of said coaxial cable and engages said shield layer.

15. The connector assembly of claim 14, further including a sleeve which extends in said longitudinal direction, said conductive connector shell extending into said sleeve, said sleeve having an inner surface comprising an inner surface portion engaging said at least one tab having said distal end and urging said distal end into engagement with said shield layer.

16. The connector assembly of claim 6 wherein said coaxial cable comprises a cable end segment comprising a length of exposed shield layer, said conductive connector shell having an end which comprises a ring into which said length of exposed shield layer is inserted, said end of said conductive connector shell being electrically and mechanically coupled to said length of exposed shield layer.

17. A kit for securing a connector to an end of a coaxial cable having a central conductor extending from said end, comprising:

an insulative bushing extending in a longitudinal direction relative to an axis of said insulative bushing, from a first bushing end to an opposite second busing end, said insulative bushing comprising a first bore extending in said longitudinal direction from said first bushing end to said opposite second bushing end, and a second bore extending from an outer surface of said insulative bushing to said first bore, said first bore comprising a first bore surface having a first bore surface portion facing said second bore said first bore being adapted to receive therein a central conductor of a coaxial cable at said opposite second bushing end such that said central conductor may be extended into said first bore from said opposite second bushing end and positioned in the vicinity of said first bore surface portion facing said second bore;

a conductive contact adapted to be inserted into said first bore from said first bushing end towards said opposite second bushing end, said conductive contact comprising a contact arm adapted to be inserted in said longitudinal direction towards said opposite second bushing end and positioned between said central conductor and said first bore surface portion; and a retaining member adapted to be inserted into said second bore, and held in place relative to said first bore surface portion to sandwich said central conductor between said retaining member and said contact arm.

18. A method of forming a connector assembly comprising the steps of:

(a) inserting a conductive contact into a first end of a first through-bore of an insulative bushing;

(b) inserting a central conductor of a coaxial cable into an opposite second end of said first through-bore until said central conductor engages a surface of said conductive contact; and (c) inserting a retaining member into a second bore, of said insulative bushing, which intersects said first bore, until said retaining member engages said central conductor, sandwiching said central conductor between said retaining member and said conductive contact.

19. The method of claim 18 further comprising the steps of:

(d) inserting said insulative bushing into a conductive connector shell;

(e) attaching a portion of said conductive connector shell to said coaxial cable; and (f) engaging said portion of said conductive connector shell with a shield layer of said coaxial cable.

* * * * *